US011963557B2

(12) United States Patent
Dillard

(10) Patent No.: US 11,963,557 B2
(45) Date of Patent: Apr. 23, 2024

(54) CRADLE

(71) Applicant: Sara Dillard, Spring, TX (US)

(72) Inventor: Sara Dillard, Spring, TX (US)

(73) Assignee: Dillard Merchandising, LLC, Spring, TX (US)

( * ) Notice: Subject to any disclaimer, the term of this patent is extended or adjusted under 35 U.S.C. 154(b) by 0 days.

(21) Appl. No.: 18/205,983

(22) Filed: Jun. 5, 2023

(65) Prior Publication Data

US 2023/0320432 A1 Oct. 12, 2023

Related U.S. Application Data

(63) Continuation of application No. 17/115,769, filed on Dec. 8, 2020, now Pat. No. 11,712,068.

(51) Int. Cl.
*A41C 1/10* (2006.01)

(52) U.S. Cl.
CPC ..... *A41C 1/10* (2013.01)

(58) Field of Classification Search
CPC ..... A41C 1/10; A41D 1/21
USPC ..... 450/18, 155
See application file for complete search history.

(56) References Cited

U.S. PATENT DOCUMENTS

| | | | |
|---|---|---|---|
| 2,023,701 | A | 12/1935 | Rosenfeld |
| 2,265,662 | A | 12/1941 | Marshall |
| 2,290,485 | A | 7/1942 | Sutter |
| 2,310,864 | A | 2/1943 | Pegg |
| 2,407,885 | A | 9/1946 | Kispert |
| 2,530,132 | A | 11/1950 | Silvain |
| 2,557,767 | A | 6/1951 | Schlageter |
| 2,617,990 | A | 11/1952 | Allard |
| 2,651,778 | A | 9/1953 | Wohlman |
| 2,718,008 | A | 9/1955 | Trznadel |
| 2,803,822 | A | 8/1957 | Doyle |
| 2,814,805 | A | 12/1957 | Blatt |
| 3,087,496 | A | 4/1963 | Norman |
| 3,115,879 | A | 12/1963 | Kaplan |
| 3,213,856 | A | 10/1965 | Gakle |
| 3,273,563 | A | 9/1966 | Bonang |
| 3,442,270 | A | 5/1969 | Steinman |
| 3,527,232 | A | 9/1970 | Rocker |
| 3,570,480 | A | 3/1971 | Stubbs |
| 3,683,935 | A | 8/1972 | Rosner |
| 3,713,450 | A | 1/1973 | Williams |

(Continued)

OTHER PUBLICATIONS

Office Action Summary for U.S. Appl. No. 17/115,769 dated Jul. 1, 2022.

(Continued)

*Primary Examiner* — Jocelyn Bravo
(74) *Attorney, Agent, or Firm* — C. Tumey Law Group PLLC

(57) ABSTRACT

A cradle that includes a maternity band, a support structure attached to the maternity band, and one or more straps attached the support structure, wherein the one or more straps include at least one top strap and at least one bottom strap. The method for using the cradle includes disposing a cradle over a midsection of a person, positioning the at least one top strap below the midsection, securing the at least one top strap to a first connection on the maternity band, positioning the at least one bottom strap above the midsection, and securing the at least one bottom strap to a second connection on the maternity band.

7 Claims, 3 Drawing Sheets

(56) References Cited

U.S. PATENT DOCUMENTS

| | | | | |
|---|---|---|---|---|
| 3,752,163 | A | 8/1973 | Kaplan | |
| 3,783,879 | A | 6/1974 | Stalder | |
| 3,920,008 | A | 11/1975 | Lehman | |
| 4,005,715 | A | 2/1977 | Moore | |
| 4,697,592 | A | 10/1987 | Maddux et al. | |
| 5,060,639 | A | 10/1991 | Marcus | |
| 5,094,648 | A * | 3/1992 | Turner | A41C 1/10 2/73 |
| 5,188,585 | A | 2/1993 | Peters | |
| 5,302,171 | A | 4/1994 | Pearson et al. | |
| 5,399,151 | A | 3/1995 | Smith | |
| 5,613,893 | A | 3/1997 | Zagame | |
| 5,690,122 | A | 11/1997 | Weber-Unger | |
| 5,702,286 | A | 12/1997 | Seering et al. | |
| 6,071,175 | A | 6/2000 | Working, III | |
| 7,160,262 | B2 | 1/2007 | Wicks | |
| 9,161,854 | B2 | 10/2015 | Fruscione-Loizides | |
| 9,179,713 | B2 | 11/2015 | Hays et al. | |
| 9,579,237 | B2 | 2/2017 | Hansen | |
| 10,226,083 | B2 | 3/2019 | Carney | |
| 11,071,330 | B2 | 7/2021 | Strottner et al. | |
| 11,147,705 | B2 | 10/2021 | Sarna et al. | |
| 11,304,455 | B1 | 4/2022 | Brooks | |
| 11,723,416 | B2 * | 8/2023 | Strottner | A41D 1/22 450/155 |
| 2003/0050584 | A1 | 3/2003 | Toda | |
| 2005/0014451 | A1 | 1/2005 | Wicks | |
| 2007/0044211 | A1 | 3/2007 | Conkle | |
| 2011/0230119 | A1 | 9/2011 | Thompson | |
| 2013/0178774 | A1 | 7/2013 | Hayes | |
| 2013/0253397 | A1 * | 9/2013 | Samoodi | A41C 1/10 602/19 |
| 2013/0344772 | A1 | 12/2013 | Fruscione-Loizides | |
| 2015/0245939 | A1 | 9/2015 | Fruscione-Loizides | |
| 2015/0320121 | A1 | 11/2015 | Fligel | |
| 2018/0007977 | A1 | 1/2018 | Windenberger | |
| 2021/0052411 | A1 | 2/2021 | Sarna et al. | |
| 2021/0205113 | A1 | 7/2021 | Wong | |
| 2021/0259873 | A1 | 8/2021 | Lyzhyn | |

OTHER PUBLICATIONS

Final Office Action Summary for U.S. Appl. No. 17/115,769 dated Mar. 3, 2023.

Notice of Allowance for U.S. Appl. No. 17/115,769 dated May 19, 2023.

* cited by examiner

CRADLE

CROSS REFERENCE TO RELATED APPLICATIONS

This application is a continuation of U.S. patent application Ser. No. 17/115,769, filed Dec. 8, 2020, which is incorporated by reference in its entirety.

BACKGROUND

During pregnancy expecting mothers may experience low back pain during. Lower back pain is due to the weight of a growing belly of the expecting mother. This additional weight pulls on the lower back of the expecting mother. Like clothing, maternity clothing does not provide any additional support to relieve pressure off the lower back of an expecting mother. Over the course of the pregnancy extended back pain may cause expecting mothers to lay down, sit down, or rest to relieve the pain. Current systems and methods are expensive, bulky, hot, uncomfortable, inflatable, and do not hold up to machine washing. The system disclosed below reduce and/or prevent lower back pain by providing expecting mothers an affordable accessory that relieves their lower-back pain with a comfortable, seamless design that can be worn under any outfit, stays in place all day, breathes like cotton, and is machine washable.

BRIEF DESCRIPTION OF THE DRAWINGS

These drawings illustrate certain aspects of the presented disclosure and should not be used to limit or define the disclosure.

DETAILED DESCRIPTION

The present disclosure is directed to a system to provide support to expecting mothers by utilizing strategically places straps attached to a stabilizing spine. These straps are pulled across parts of the back and abdomen and attached in places that pull the belly back towards the spine in a safe and supportive nature. The spine and straps are made of a durable, breathable, and elastic fabric that may be adjusted as the belly grows and can be washed and dried after every use. When worn, the system lays flat and seamless against the body, allowing the expecting mother to wear it with virtually any outfit. The system described below is referred to as a cradle below.

Figure 1:
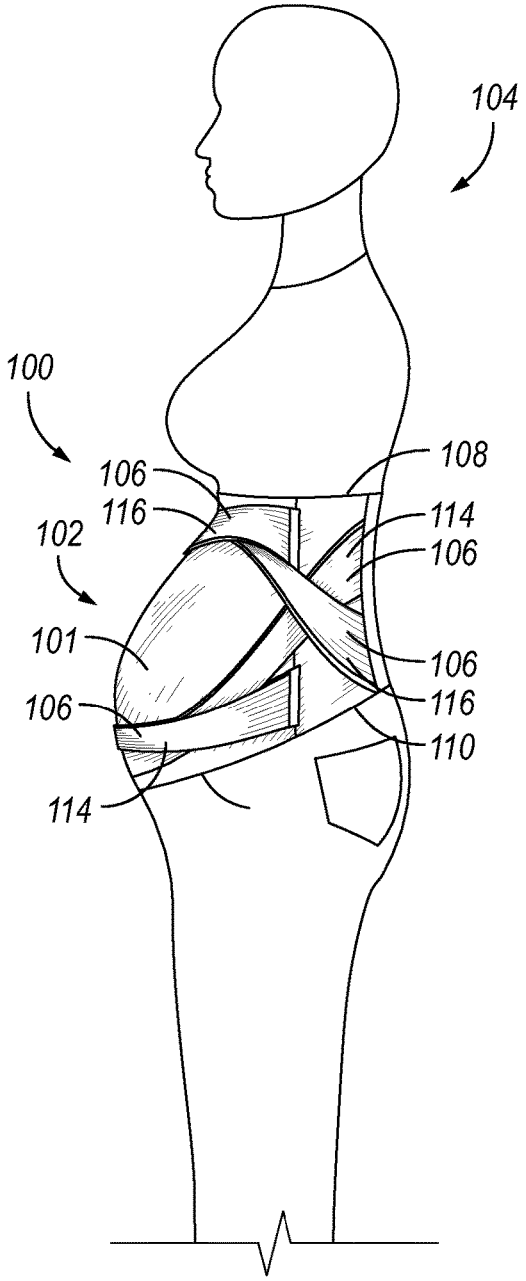
FIG. 1 illustrates a side view of a Cradle disposed on a woman.
Figure 2:
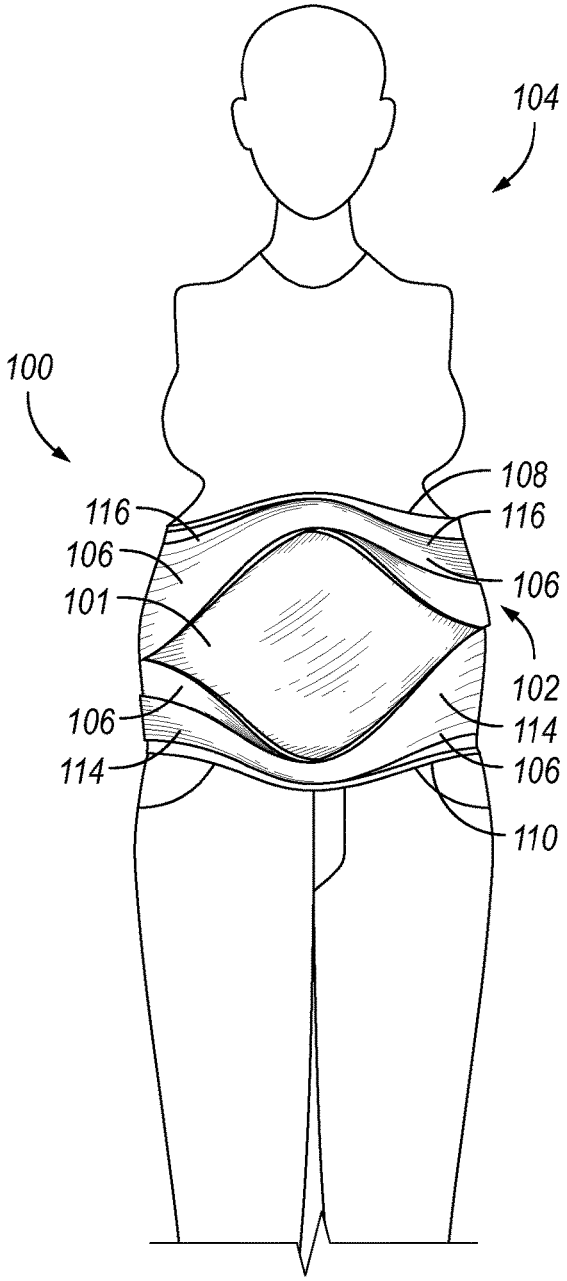
FIG. 2 illustrates a front view of the Cradle disposed on the woman.

FIG. 1 illustrates a side view of cradle 100 disposed about a midsection 102 of a woman 104. FIG. 2 illustrates a front view of cradle 100 disposed about midsection 102 of a woman 104. In reference to both FIGS. 1 and 2, cradle 100 may be formed from a maternity band 101 and one or more support straps 106. Maternity band 101 may be manufactured from a flexible, stretchable material capable of being expanded and stretched to be firmly but comfortably worn around a woman during pregnancy or postpartum approximately at or about midsection 102. Maternity band 101 may range from about five inches (13 cm) (when folded over on itself) to nineteen inches (50 cm) in height. Additionally, cradle 100 may be about six to twelve inches (15-30 cm) in height, or about ten to twelve inches (25-30 cm), and of a circumference which will accommodate a pregnant woman of a designated size range, the circumference preferably being between 20 and 30 inches (50-80 cm). In examples, the circumference of maternity band 101 is between 20 and 35 in (50-63 cm). In another example, the circumference of maternity band 101 is between 15 and 35 in (38-63 cm).

With continued reference to FIG. 1 and FIG. 2, maternity band 101 may have a top 108 and a bottom 110 that may be defined by a seam, seamless, a hemline, a fold in the fabric of the band garment, a change in pattern, design or color of the band garment, or by any other means. Additionally, top 108 and bottom 110 may have different circumference or the same circumference. As illustrated in FIG. 1 and FIG. 2, top 108 has a small circumference then bottom 110. Although not illustrated, maternity band 101 may include a silicone strip or coating applied within the inner surface of maternity band 101 at any suitable location. For example, at or near top 108, bottom 110, and/or centered between top 108 and bottom 110. The silicone strip or coating may be applied to help the garment adhere or stick to the body of the woman and/or prevent the garment from moving during use. The silicone strip or coating may be applied to the garment using any technique known in the art such as knife coating, dip/immersion coating, rotogravure coating, extrusion, or spraying.

The flexible, stretchable material of maternity band 101 may have a weight (also referred to as fabric density) ranging from 190 grams/square meter to 330 grams/square meter ($gm/m^2$). Maternity band 101 may be manufactured from a piece of circularly knitted fabric such as a single knit or double knit. In examples, maternity band 101 is manufactured using an electronic circular knitting machine or electronic warp knitting machine for seamless products, such as the single jersey, double jersey, or warp seamless machines. In examples, maternity band 101 may be a single piece that is pulled over the woman 104 and disposed over midsection 102, where midsection 102 is where a baby bump is located. In other examples, not illustrated, maternity band 101 may be formed from one or more pieces that attach to each other. In this case, the woman 104 may wrap maternity band 101 around midsection 102 before securing the pieces of maternity band together.

Maternity band 101 may be formed of stretchable material, as discussed above, and may be designed such that one size fits most users, although two or more different sizes may be provided, for different sizes of women. Sizes may be designated by numbers or letters. For example, maternity band 101 may be available in different sizes, such as sizes 0-4, wherein size 0 is the smallest available garment with the smallest measurement and size 4 is the largest garment with the largest measurement. Alternatively, sizes may be designated by letters such as "S/M" indicating a small to medium sized garment, "M/L" indicating a medium to large sized garment, and "L/XL" indicating a large to extra-large sized garment. It is intended that a maternity band 101 of a single size will fit a particular pregnant woman throughout the period of time when she cannot wear her normal clothing or is too small for maternity wear.

In examples maternity band 101 is of knit fabric, in basic colors typical of bottom-half clothing today such as black, khaki, denim-color blue, and white. Maternity band 101 may also be made in various and seasonal patterns and colors if desired. Maternity band 101 may also be textured or adorned with any decoration known in the art such as lace, beads, or decorative stitching.

The knit fabric may be any knit fabric known in the art such as double-knit fabric, single knit fabric, baby rib knit, interlock knit, fleece, stretch velvet, or textured novelty knit. In one embodiment, the knit fabric is jersey fabric. The garment may be seamless (or it can be seamed) and of a stretchable, knit nylon/spandex (elastane) blend. The knit fabric nylon/spandex blend may include 75-95% nylon and 5-25% spandex. For example, the nylon/spandex blend may include 79% nylon and 21% spandex, 80% nylon and 20% spandex, 82% nylon and 18% spandex, 84% nylon and 16% spandex, 85% nylon and 15% spandex, 87% nylon and 13% spandex, 89% nylon and 11% spandex, 90% nylon and 10% spandex, 93% nylon and 7% spandex, or 95% nylon and 5% spandex. In another embodiment, the band garment 10 is made of a knit fabric such as a cotton spandex blend or an organic cotton spandex blend. For example, the knit fabric cotton blend may be 90% cotton and 10% spandex, 95% cotton and 5% spandex, or 95% organic cotton and 5% spandex. In other embodiments, the band garment 10 may be made of other suitable fabrics known in the art such as polyester, nylon, lyocel, rayon, polyamide, or viscose.

Figure 3:
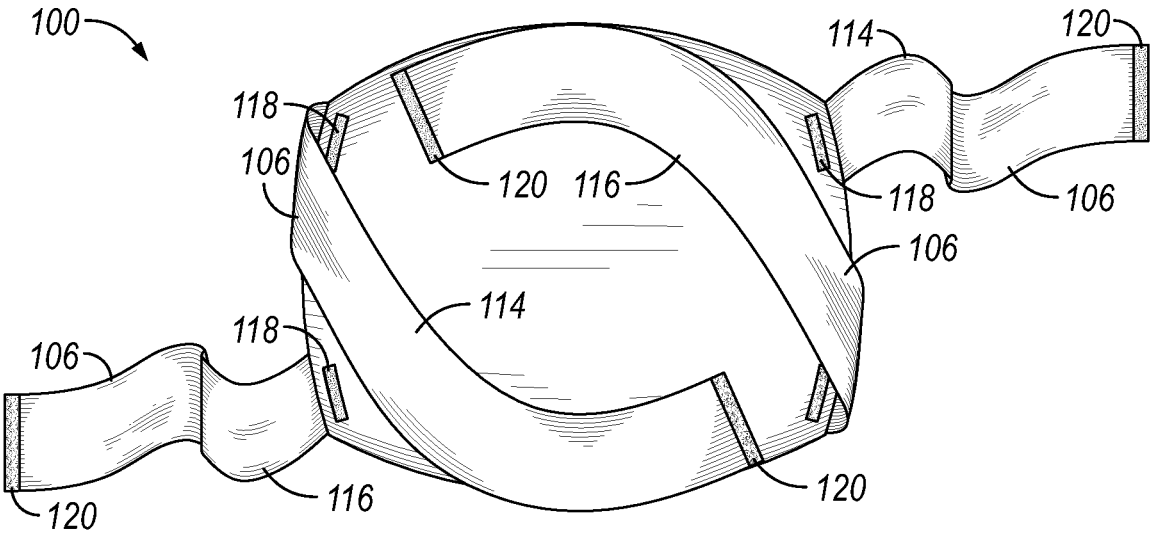
FIGS. 3 and 4 illustrate a front view of the Cradle.
Figure 4:
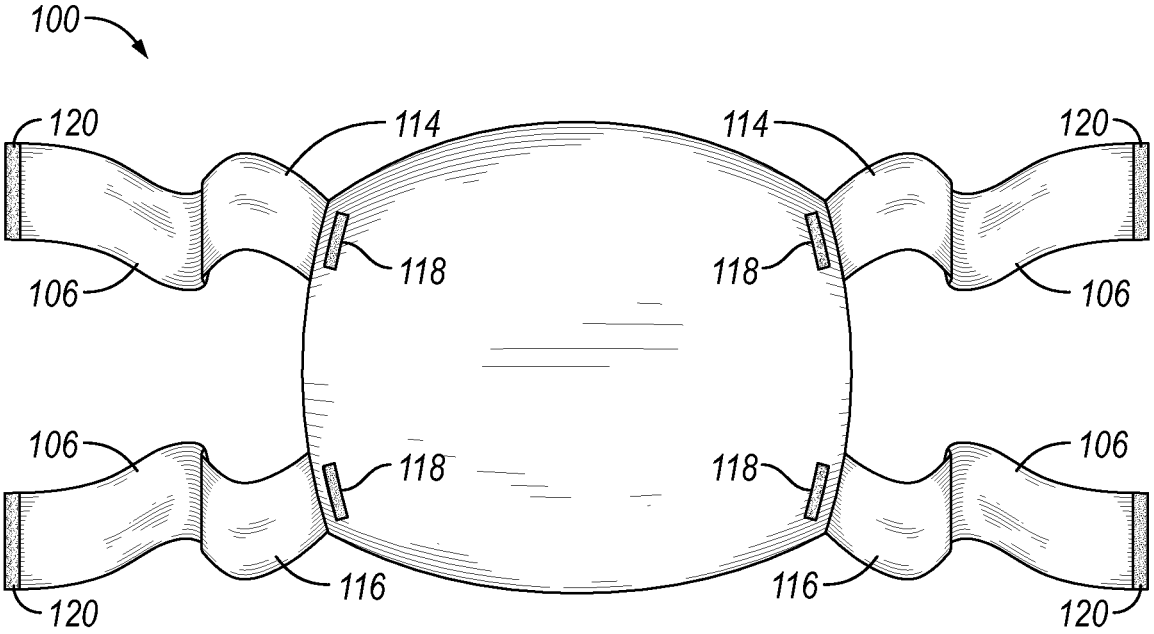
Figure 5:
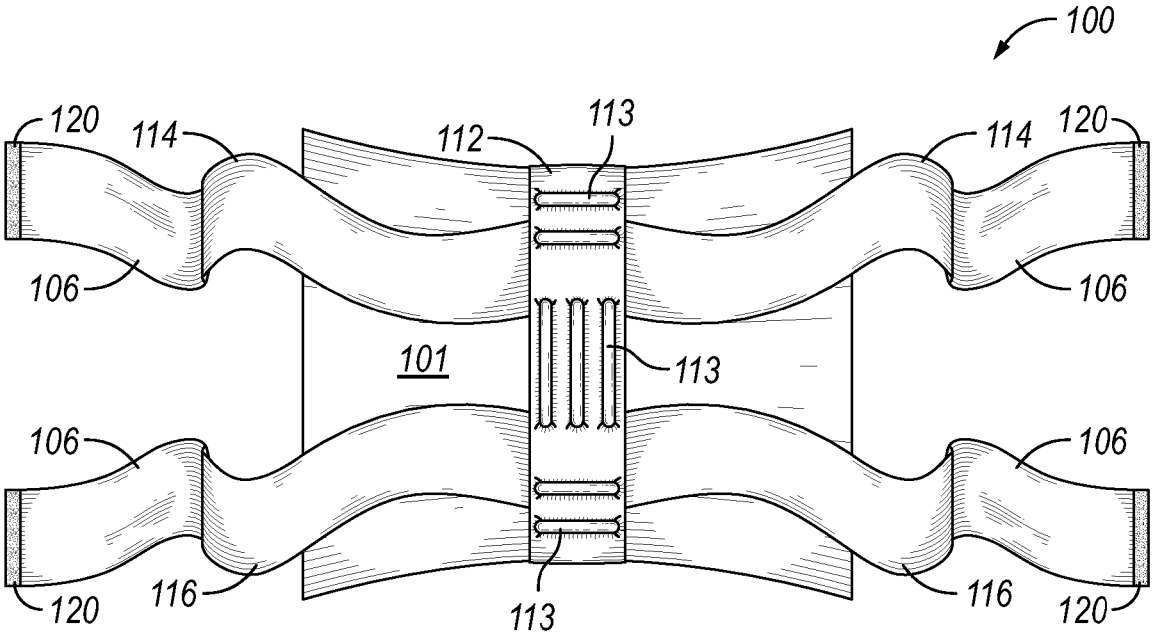
FIGS. 5 and 6 illustrate a back view of the Cradle.
Figure 6:
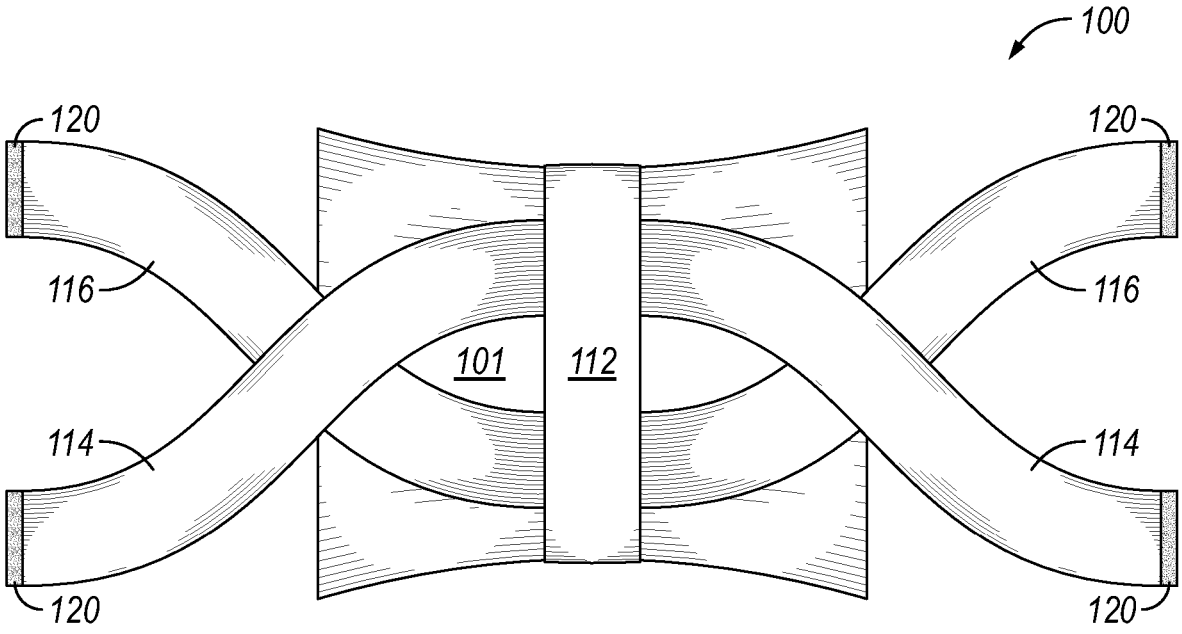

In reference to FIG. 1, cradle 100 may include one or more straps 106, which may be attached to support structure 112. FIGS. 3 and 4 illustrate a front view of cradle 100 that includes one or more straps 106. FIGS. 5 and 6 illustrate a back view of cradle 100 that includes one or more straps 106 attached to support structure 112. In examples, one or more straps 106 may be attached to support structure 112 by any suitable means. For example, one or more straps 106 may be attached to support structure 112 by stitching such as with a stronghold stitch. In examples, one or more straps 106 and support structure 112 may be formed of the same material and be of a single body construction.

As illustrated in FIGS. 3 and 4, one or more straps 106 may be any suitable length to account for the size of woman 104 and size of midsection 102 (e.g., referring to FIGS. 1 and 2). In examples, each of the one or more straps 106 may be about ten inches to about thirty-five inches, about twenty inches to about thirty inches, about twenty-five inches to about twenty-eight inches, about twenty-two inches, about twenty-three inches, about twenty-four inches, about twenty-five inches, about twenty-eight inches, and/or about twenty-nine inches. In examples, each of the straps may be different lengths. Additionally, each of the straps may be adjustable to change to any suitable length, such as the lengths disclosed above. One or more straps 106 may be broken down into top straps 114 and bottom straps 116. Referring to FIGS. 1 and 2, tops straps 114 are configured to cross over midsection 102 (which may be referred to as a belly) of woman 104. Referring back to FIGS. 3 and 4, top straps 106 may be connected to maternity band 102 at one or more connections 118. In examples, one or more straps 106 may include any suitable type of fasteners 120, which may allow fasteners 120 to connect to connections 118. In examples, fasteners 120 may include, hook and loop, buttons, ties, zippers, fabric ties (in all fabric types), laces (all types of lace), hook & eye, snaps, buttons with loops, button hooks, frog & toggle, frog closure, toggle closure, studs, poppers, buckles, magnets, pins, grommets, rivets, brooches, clasp, beads, ribbon, and/or the like. Top straps 114 may provide lift, which may reduce pressure off the lower back and pelvis of woman 104 (e.g., referring to FIG. 1 or 2). Because back/sciatica and pelvic pain is common in pregnancy, top straps 114 may alleviate this pain experience by woman 104 during pregnancy.

As illustrated in FIGS. 1 and 2, bottom straps 116 are configured to cross over midsection 102 (which may be referred to as a belly) of woman 104. Referring back to FIGS. 3 and 4, bottom straps 116 may be connected to maternity band 101 at one or more connections 118. In examples, one or more straps 106 may include any suitable type of fasteners 120, which may allow fasteners 120 to connect to connections 118. In examples, fasteners 120 may include, hook and loop, buttons, ties, zippers, fabric ties (in all fabric types), laces (all types of lace), hook & eye, snaps, buttons with loops, button hooks, frog & toggle, frog closure, toggle closure, studs, poppers, buckles, magnets, pins, grommets, rivets, brooches, clasp, beads, ribbon, and/or the like. Bottom straps 116 may provide additional lift, which may reduce pressure off the lower back and pelvis of woman 104 (e.g., referring to FIG. 1 or 2). Because back/sciatica and pelvic pain is common in pregnancy, bottom straps 116 may alleviate this pain experience by woman 104 during pregnancy. Additionally, bottom straps 116 may further secure maternity band 101 in place. This may prevent cradle 100 from shifting of a woman's body during movement.

As illustrated in FIGS. 5 and 6, one or more straps 106 may be attached to support structure 112. Support structure 112 provides structural support to maternity band 101. This may allow maternity band 101 to stay upright and give the cradle 100 enough strength to give top straps 114 and bottom straps 116 the lifting power needed to alleviate pressure on the back and pelvis of the woman (e.g., referring to FIGS. 1 and 2) as discussed above. Support structure 112 may have a height between five inches and ten inches, about six inches, about seven inches, or about eight inches. Additionally, support structure 112 may have a width between on inch and five inches, about two inches, about three inches, or about four inches. In example, the width of support structure 112 may change. For example, closer to top 108 and bottom 110 the width of support structure may be wider than the area between top 108 and bottom 110, or vice versa. Without limitation, support structure 112 may have boning 113, disposed within the fabric of support structure 112. In examples, there may be a single piece of boning 113 or a plurality of boning 113. Boning 113 may add additional support to the fabric that forms support structure 112. Without limitation there may be any number of boning 113 devices in support structure 112. Boning 113 may run horizontally, vertically, or both in support structure 112.

Improvements of cradle 100 include lifting weight of the spine of an expecting mother. This may be done through one or more straps 106 that are attached to a support structure 112, which is attached to maternity band 101. Top straps 114 may be disposed below midsection 102, where the baby bump is located, and bottom straps 116 may be disposed above midsection 102. The one or more straps 106 pull midsection 102 closer to the spine of the expecting mother, which reduces weight, and ultimately pain, along the lower back of the expecting mother. Cradle 100 meets a long felt need in the maternity clothing field. Specifically, cradle 100 transfers weight from the midsection area of the woman to the back and spine of the woman. This allows for weight to be transferred down the woman's spine to her feet. This reduces lateral strain on the spine from the weight in the midsection, providing comfort to the woman and reducing back pain. While current maternity garments compress the midsection, there are not maternity garments that actively redistribute weight from the midsection to the spine of the woman. This greatly reduces back pain experienced by the woman during pregnancy.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the element that it introduces.

All numerical values within the detailed description and the claims herein modified by "about" or "approximately" with respect to the indicated value is intended to take into account experimental error and variations that would be expected by a person having ordinary skill in the art.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

disposing a cradle over a midsection of a person, wherein the cradle comprises: a maternity band;

a support structure attached to the maternity band; and a plurality of straps attached the support structure, wherein the plurality of straps includes at least one top strap and at least one bottom strap; and positioning the at least one top strap below the midsection;

securing the at least one top strap to a first connection on the maternity band;

positioning the at least one bottom strap above the midsection; and securing the at least one bottom strap to a second connection on the maternity band.

2. The method of claim 1, wherein the cradle is formed from one or more pieces.

3. The method of claim 2, further comprising wrapping the cradle around the midsection and connecting the one or more pieces together.

4. The method of claim 1, wherein the support structure includes at least one piece of boning.

5. The method of claim 4, wherein the least one piece of boning is disposed vertically along the support structure.

6. The method of claim 4, wherein the least one piece of boning is disposed horizontally along the support structure.

7. The method of claim 1, wherein the plurality of straps include at least one fastener that is configured to attach to at least one of the first connection or the second connection.

* * * * *